US005096459A

United States Patent [19]

Ghorashi

[11] Patent Number: 5,096,459

[45] Date of Patent: Mar. 17, 1992

[54] METHOD OF DYEING AROMATIC POLYAMIDE FIBERS WITH WATER-SOLUBLE DYES

[75] Inventor: Hamid M. Ghorashi, Midlothian, Va.

[73] Assignee: E. I. Du Pont de Nemours and Company, Wilmington, Del.

[21] Appl. No.: 675,109

[22] Filed: Mar. 25, 1991

Related U.S. Application Data

[63] Continuation-in-part of Ser. No. 588,276, Sep. 26, 1990, abandoned.

[51] Int. Cl.[5] ..... C09B 67/00

[52] U.S. Cl. ..... 8/584; 8/492; 8/607; 8/611; 8/654; 8/655; 8/657; 8/925

[58] Field of Search ..... 8/584, 607, 611

[56] References Cited

U.S. PATENT DOCUMENTS

| | | | |
|---|---|---|---|
| 3,674,420 | 7/1972 | Sapers | 8/607 |
| 4,144,023 | 3/1979 | Provost | 8/489 |
| 4,668,234 | 5/1987 | Vance et al. | 8/115.6 |
| 4,752,300 | 6/1988 | Johnson | 8/584 |
| 4,755,335 | 7/1988 | Ghorashi | 264/48 |
| 4,780,105 | 10/1988 | White et al. | 8/574 |
| 4,883,496 | 11/1989 | Ghorashi | 8/476 |
| 4,919,869 | 4/1990 | Zatkulak et al. | 264/78 |
| 4,985,046 | 1/1991 | Hartzler | 8/654 |

*Primary Examiner*—A. Lionel Clingman

[57] ABSTRACT

Aromatic polyamide fibers, which have been dried and/or crystallized, are steam dyed with a water-soluble dye padded onto the surface of fibers, along with a small amount of a carrier.

22 Claims, No Drawings

METHOD OF DYEING AROMATIC POLYAMIDE FIBERS WITH WATER-SOLUBLE DYES

This patent is a continuation-in-part of Ser. No. 07/588,276 filed 9/26/90, now abandoned.

BACKGROUND OF THE INVENTION

1. Field of the Invention

The field of art to which this invention pertains is aromatic polyamide fibers and, more particularly, it is directed to methods of dyeing these fibers.

Specifically, the instant invention is a method of dyeing a fiber structure or two of dried or crystalline poly(m-phenylene isophthalamide) fibers or filaments with a water-soluble dye padded onto the fibers, along with a small amount of a suitable dye carrier. The tow is heated with steam at a temperature of at least about 120° C. for a time sufficient to dye the fibers adjacent their surface and at about 165° C. to completely due the fibers throughout their structure.

By following the method of this invention, amorphous or crystalline poly(m-phenylene isophthalamide) fibers may be efficiently dyed a bright deep color in a short period of time with highly compatible water-soluble dyes, at relatively low temperatures, e.g., below about 165° C., using carrier amounts of less than 5 wt. % based on fiber weight, and preferably even lesser amounts (1 to 2%) without loss of dye effectiveness.

2. Description of the Related Art

Aromatic polyamide fibers are known to the art. They have outstanding properties such as high tensile strength, flame and heat resistance, and good flex life which make them suited to be formed into fabrics usable as protective clothing, and for many other uses.

More specifically, this invention is directed to a method of dyeing aromatic polyamide fibers of a poly(m-phenylene isophthalamide) polymer, hereinafter referred to as "MPD-I fibers". Such fibers, which are described in greater detail in U.S. Pat. No. 3,287,324 to Sweeny, for example, posses many useful properties, as indicated above.

Briefly described, the MPD-I fibers of the type involved in this invention are typically formed by extruding a spinning solution through orifices in a spinneret. Such fibers may be dry-spun or wet-spun, by known methods, to form a "water-swollen" fiber structure. Such fibers, which are substantially amorphous at this stage, in turn, are brought into contact with an aqueous extraction bath, then combined in "water-swollen" form into tow and appropriately dried, generally at about 140° C.

For certain uses, these dried amorphous fibers may be further heated to form crystalline MPD-I fibers. In either case, however, it is well known to the art that dried MPD-I fibers, whether amorphous or crystalline are very difficult to dye.

As a result, many methods have evolved, over the years, for dyeing MPD-I fibers in various forms. U.S. Pat. No. 4,883,496 to Ghorashi describes a number of these methods. The teachings of this patent are incorporated herein by reference.

As described in this patent, the most generally accepted method for dyeing MPD-I fibers has been to dye the fibers, after they have been dried, in a pressure vessel at 121° to 132° C., using an aqueous dyebath containing a large percentage of a carrier, such as acetophenone. For amorphous fibers, the amount of carrier used is around 40%, based on the weight of the fibers; for crystalline MPD-I fibers, the amount of carrier used is even higher, sometimes approaching 100%, based on the weight of the fibers.

This method has proven to be very effective for dyeing dried MPD-I fibers with water-soluble dyes. However, the large amount of carrier involved can present certain cost and dyebath disposal problems to the user. Further, several hours are generally required to achieve the depth of color desired in the finished product. Also, this method is more suitable for dyeing fabric, than for dyeing tow.

Accordingly, a method has long been sought for dyeing amorphous or crystalline MPD-I tow using water-soluble dyes, without the need to use aqueous dyebath techniques, to obtain a wide range of colors while retaining good fiber properties. It has been especially desired to achieve a process for applying such dyes at relatively low temperatures, e.g., 165° C. or less, since many otherwise desirable dyes are unstable at higher temperatures. And, it further has been desired to be able to dye crystalline or amorphous MPD-I tow continuously within a relatively short time, e.g., 30 minutes or less. It also has been desired to be able to dye MPD-I tow with low levels of dye carriers, for example, less than 40% by weight of fibers.

This invention solves these and other problems found in the prior art by surprisingly finding that by heating dried, crystalline or amorphous MPD-I fibers with steam, heated within certain temperature ranges in the presence of a very small amount of carrier, it is possible effectively to dye the fibers. Specifically, it has been found that such fibers may be dyed with a water-soluble dye which is padded into the fibers, along with from about 0.5 to 5 wt. % of a suitable carrier, and then heated with steam at temperatures from 120° to 165° C. At the lower 120° C. temperature range, the fibers are effectively surface dyes; for more complete dyeing of the fiber structure the higher 165° C. temperature range is required. These fibers may be dyed in a very short period of time (e.g., less than 30 minutes), with little or no residual carrier disposal problem. In so doing, the method of this invention provides the art with an effective, improved means of dyeing amorphous or crystalline MPD-I fibers with a large variety of water-soluble dyestuff.

SUMMARY OF THE INVENTION

Briefly described, this invention is a method of dyeing a tow of poly(m-phenylene isophthalamide) fibers, which have been previously dried, comprising the steps of padding onto the surface of the fibers of the two an aqueous solution of from about 0.5 to 5 wt. % of a carrier, based on the weight of the fibers, and from about 0.5 to 5 wt. % of a water-soluble dye, based on the weight of the fibers, and thereafter heating the two with steam at a temperature of at least about 120° C. for a time sufficient to dye the fibers on and closely adjacent the surface thereof.

By raising the steam temperature to about 165° C., the fibers may be more completely dyed, substantially to the center thereof.

Either amorphous or crystalline MPD-I fibers may be effectively dyed in less than 30 minutes by this method.

In preferred embodiments of this invention, the amount of carrier padded onto the fibers can be from about 1 to 2 wt. % and the amount of dye from about 2 to 3 wt. %, based on the weight of the fibers. This minimal use of carrier greatly reduces any disposal problems particularly since much of the remaining carrier dissipates or is distilled off with the steam, while still providing improved deep color dyeing of the two.

DESCRIPTION OF THE PREFERRED EMBODIMENTS

This invention is an improved method of dyeing aromatic polyamide fibers.

More specifically, in the method of the invention, steam heated at critical temperatures, is used to dye a tow of amorphous crystalline poly(m-phenylene isophthalamide) fibers (e.g., MPD-I fibers), with a water-soluble dye which has been padded onto the fibers, along with a small amount of a suitable carrier.

In a preferred embodiment, the instant method is particularly suited to dye crystalline MPD-I fibers. These crystallized fibers are available commercially, for example, from E. I. du Pont de Nemours and Company, under the trademark NOMEX Type 450. Such aramid fibers are made using methods well known to, and described in, the published art.

Briefly, in greater detail, the fibers of this structure are prepared from aromatic polyamide polymers such as are disclosed in U.S. Pat. Nos. 3,063,966 to Kwokek, Morgan and Sorenson, 3,094,511 to Hill, Kwolek and Sweeny; and 3,287,324 Sweeny, for example. These patents, and their techniques, are incorporated by reference into this application.

In the present invention, the term "aromatic polyamide" means a synthetic polymeric material of sufficiently high molecular weight to be fiber-forming, and characterized predominantly by the recurring structural unit

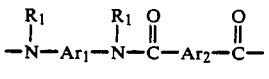

wherein each $R_1$ independently is hydrogen or lower alkyl and wherein $Ar_1$ and $Ar_2$ may be the same or different and may be an unsubstituted divalent aromatic radical or a substituted divalent aromatic radical, the chain-extending bonds of these divalent aromatic radicals being oriented predominantly meta to one another and the substituents attached to any aromatic nucleus being one or more or a mixture of lower alkyl, lower alkoxy, halogen, nitro, lower carbalkoxy, or other group which do not form a polyamide during polymerization. these polymers may be prepared by following the teachings of U.S. Pat. Nos. 3,094,511; 3,287,324 or 3,063,966 mentioned above.

In preparing the basic untreated MPD-I fibers forming a part of this invention, aromatic polyamides which have been prepared by procedures shown in the above-mentioned patents are combined with various solvents such as dimethylacetamide to form a spinning solution as shown, for example, in U.S. Pat. No. 3,063,966 and the fibers or filaments are formed by extruding the spinning solution through orifices in a spinneret. Such fibers may be dry-spun or wet-spun to form a water-swollen fiber structure. In either case, the fibers as spun are substantially amorphous.

"Dry spinning" refers to a process in which the spinning solution is extruded in the form of thin streams into a heated cell wherein sufficient solvent is caused to evaporate so that the streams are converted into individual filaments which are "dry" enough even though still containing appreciable quantities of residual solvent that they are self-supporting. "Wet-spinning" involves a process wherein the polymer spinning solution exits in the form of thin streams which are generated within, or are conducted into, a liquid coagulating bath which causes the polymer to precipitate in the form of self-supporting filaments which may be conducted out of the coagulating bath, and commonly also through subsequent processing steps. Depending on the composition of the coagulating bath, the temperature and time of contact of the filaments with the bath, the filaments may still retain an appreciable quantity of the original polymer solvent at the time they exit the bath.

As just stated the fibers whether dry-spun or wet-spun contain a substantial amount of solvent after having been solidified in a dry-spinning evaporation cell or coagulated in a wet-spinning precipitation bath. To remove the solvent such fibers are brought into contact with an aqueous extraction bath, as is known in the art. As a result the fibers become "water-swollen" with a water content of 35% or more.

The above-described steps of forming amorphous water-swollen fibers of an aromatic polyamide polymer are known to the art. These fibers are suitable for being further treated or processed prior to being dyed with water-soluble dyes in accordance with the method of this invention.

More specifically, such water-swollen fibers are suitably dried, by conventional methods, prior to being steam-dyed using the method of this invention. As thus dried, depending on the drying techniques used, such fibers, whether amorphous or crystalline, are in suitable form for dyeing. These drying methods are well known to the art.

In a preferred embodiment, the instant invention is directed to a method of dyeing MPD-I fibers after they have been crystallized. The stretching and heat crystallization of fibers spun from MPD-I polymer are disclosed in U.S. pat. No. 3,133,138 to Alexander, the teachings of which are incorporated herein by reference. These crystalline MPD-I fibers are more difficult to dye than amorphous (non-crystalline) MPD-I fibers, especially when relatively dilute dye solutions or dispersions are used in a dye bath, as is customary in conventional dyeing operations.

This problem is solved by the present invention, wherein a water-soluble dye is mixed with a small amount of a carrier (from 0.5 to 5 wt. %, and preferably from 1 to 2 wt. %, based on the weight of the fibers) to form an aqueous solution which is coated or padded onto the surface of the crystalline MPD-I fibers and dyed into the fibers at a relatively low temperature (165° C. or less) in an atmosphere of saturated steam within a relatively short time.

Preferably, the carrier utilized is acetophenone and the amount of dye in the padded-on solution is from 0.5 to 5 wt. %., based on the weight of the fibers. Other suitable carriers are benzyl alcohol and cyclic phosphonate esters as disclosed, for example, in U.S. Pat. No. 4,752,300 to Johnson, the teachings of which are incorporated herein by reference. The dye utilized is preferably cationic.

After the solution is padded onto the fibers, which have been gathered together to form a tow, the tow is heated with steam at 120° C. for a time sufficient to dye the fibers at least adjacent the surface thereof. If it is desired to dye these crystalline fibers throughout their structure, to a deep bright color, the steam temperature is raised to a higher temperature (e.g, about 165° C.) for effective dyeing.

A suitable apparatus for steam dyeing these crystalline MPD-I fibers, using steam, heated to these critical temperatures, is shown and described in U.S. Pat. No. 4,919,869 to Zatkulak et al. The teachings of this patent are incorporated herein by reference.

In another preferred embodiment, the dried MPD-I fibers, dyed by the method of this invention, are amorphous in form. The "water-swollen" fibers, previously described, are readily dried to an amorphous state by heating them to about 100° C. or slightly higher, to drive off substantially all the water. This can be done by passing them over rolls heated to about 100° C. or slightly higher, to drive off substantially above 100° C., without changing their amorphous condition. In turn, these fibers can be dyed, as effectively, as were the crystalline fibers, as described above, using the same conditions and generally following the same method steps.

The following Examples further illustrate the method of dyeing amorphous and crystalline MPD-I fibers with water-soluble dyes, in accordance with the invention.

EXAMPLE 1

A 60-kilotex (550,000 denier) two of crystalline MPD-I filaments having a linear density of about 1.65 decitex (1.5 dpf) (available as Type 450 NOMEX aramide fiber from E. I. du Pont de Nemours and Company) was padded with an aqueous solution of 60 g/L of C. I. basic Red 46 dye (a water-soluble dye), 50 g/L of acetophenone, 2 g/L of acetic acid, and 1 g/L of sodium chloride by feeding the two between nip rolls at the rate of 12 m/minute at a pressure of 203 kPa (two atmospheres) with the aqueous solution contained above the nip rolls. The pick-up of the aqueous solution on the tow was about 33 wt. %, based on the dry weight of the tow. Based on the amount of solution pickup, the amount of dye was 1.98 wt. % of dry fiber weight and the amount of carrier was 1.65 wt % of the dry fiber weight. The tow, padded with the solution so that the individual filaments were well and uniformly coated with the solution, was then exposed to steam by passing the two through the apparatus shown and described in U.S. Pat. No. 4,919,869 to Zatkulak et al. Such apparatus contains first and second steam treatment sections. A first portion of the tow was exposed to steam at a temperature of 120° C. and a pressure of 101.5 kPa (one atmosphere) throughout both sections of the apparatus. A second portion of the tow was exposed to steam at a temperature of 120° C. and at a pressure of 101.5 kPa in the first steam treatment section and to steam at a temperature of 165° C. and at a pressure of 609 kPa (six atmospheres) in the second steam treatment section. After a total exposure time of about 15 minutes, each tow was washed with water as it passed out of the apparatus. It was observed that very good exhaustion of the dye was obtained in treating the two first at 120° C. and then at 165° C., while there was not as good utilization of the dye when the tow was steam treated only at 120° C. The tow treated first at 120° C. and then at 165° C. was dyed to a deep shade of red, and when the fibers in the tow were cross-sectioned they were found to be dyed throughout the fibers, all the way to the center of the fibers. The tow treated only at 120° C. was dyed to an acceptable shade of red, although not quite as deep a shade of red as the other fiber; and when the fibers in this tow were cross sectioned, they were found to be dyed only adjacent to the surface of the fiber ("ring dyed"), with no dye penetrating to the center of the fibers. The physical properties of the fibers in both of the dyed tows (the tow treated only at 120° C. and the tow treated first at 120° C. and then at 165° C.) were substantially unchanged from the physical properties of the fibers in the two before it was padded with dye solution and steam treated. No odor of acetophenone was detectable in either of the dyed tows.

The example was repeated, except the tow was padded with an aqueous solution of 60 g/L of C. I. Basic Red 46 dye, only 25 g/L of acetophenone (e.g., about 0.825 wt. % of the dry fiber weight), 2 g/L of acetic acid, and 1 g/L of sodium chloride. Part of the tow was steam treated only at 120° C. and another portion was steam treated first at 120° C. and then at 165° C., as above. In both cases there was not as good utilization of the dye as when the tow was padded with a solution containing 50 g/L of acetophenone (more residual dye washed off the tow in the washing step). In both cases the tows were dyed to acceptable shades of red, but the colors were somewhat less intense than in the fibers dyed with 50 g/L of acetophenone rather than 25 g/L. As in the experiments described above, the fibers in the tow treated first at 120° C. and then at 165° C. were dyed all the way to the center of the fibers, while the fibers in the tow treated only at 120° C. were found to be dyed only adjacent to the surface of the fibers ("ring dyed").

EXAMPLE 2

Example 1 was repeated, except that the aqueous solution with which the tow was padded contained 50 g/L of benzyl alcohol rather than 50 g/L of acetophenone, the other components of the solution being present in the same concentrations stated in Example 1.

When a portion of the tow was exposed to steam at a temperature of 120° C. and at a pressure of 101.5 kPa (one atmosphere) throughout both sections of the apparatus for a total exposure time of about 15 minutes, followed by washing of the tow, it was observed that the tow was dyed to a light shade of red.

When a portion of the tow was exposed to steam at a temperature of 120° C. and at a pressure of 101.5 kPa (one atmosphere) in the first steam treatment section and to steam at a temperature of 165° C. and at a pressure of 609 kPa (six atmospheres) in the second steam treatment section for a total exposure time of about 15 minutes, followed by washing of the tow, it was observed that the tow was dyed to a deep shade of red.

EXAMPLE 3

Example 1 was repeated, except that the aqueous solution with which the tow was padded contained, rather than 50 g/L of acetophenone, 50 g/L of a mixture of cyclic phosphonate esters comprising the 50:50 mixture of mono- and di-esters disclosed in column 3, lines 19–36 of U.S. Pat. No. 4,752,300 (commercially available as "Antiblaze 19" from Albright & Wilson, Inc., of Richmond, Va.).

When a portion of the tow was exposed to steam at a temperature of 120° C. and at a pressure of 101.5 kPa (one atmosphere) throughout both sections of the apparatus for a total exposure time of about 15 minutes, followed by washing of the tow, it was observed that the tow was dyed to a light shade of red.

When a portion of the tow was exposed to steam at a temperature of 120° C. and at a pressure of 101.5 kPa (one atmosphere) in the first steam treatment section and to steam at a temperature of 165° C. and at a pressure of 609 kPa (six atmospheres) in the second steam treatment section for a total exposure time of about 15 minutes, followed by washing of the tow, it was observed that the tow was dyed to a medium shade of red.

What is claimed is:

1. A method of dyeing a tow of poly(m-phenylene isophthalamide) fibers, which tow has been dried, comprising the steps of padding onto the surface of the fibers of the tow an aqueous solution of from about 0.5 to 5 wt. % of a acetophenone carrier, based on the weight of the fibers, and from about 0.5 to 5 wt. % of a water-soluble cationic dye, based on the weight of the fibers, and thereafter heating the tow with steam at a temperature of about at least 120° C. for a time sufficient to dye the fibers on and closely adjacent the surface thereof.

2. The method of claim 1 wherein the tow is in the form of amorphous poly(m-phenylene isophthalamide) fibers.

3. The method of claim 1 wherein the tow is in the form of crystalline poly(m-phenylene isophthalamide) fibers.

4. The method of claim 1 wherein the two of poly(m-phenylene isophthalamid) fibers is dyed in less than 30 minutes.

5. The method of claim 1 wherein the amount of acetophenone carrier padded onto the surface of fibers is from about 1 to 2 wt. % based on the weight of the fibers.

6. The method of claim 1 wherein the amount of the cationic dye padded onto the surface of the fibers is from about 2 to 3 wt. % based on the weight of the fibers.

7. The method of claim 1 wherein the tow is heated with steam at a temperature of about 165° C. for a time sufficient to dye the fibers substantially to the center thereof.

8. A method of dyeing a tow of poly(m-phenylene isophthalamide) fibers, which tow has been dried, comprising the steps of padding onto the surface of the fibers of the tow an aqueous solution of from about 0.5 to 5 wt. % of acetophenone carrier, based on the weight of the fibers, and from about 0.5 to 5 wt. % of a cationic water-soluble dye, based on the weight of the fibers, and thereafter heating the two with steam at a temperature of about 165° C. for a time sufficient to dye the fibers to the center thereof.

9. The method of claim 8 wherein the tow is in the form of amorphous poly(m-phenylene isophthalamide) fibers.

10. The method of claim 8 wherein the tow is in the form of crystalline poly(m-phenylene isophthalamide) fibers.

11. The method of claim 8 wherein the tow of poly(m-phenylene isophthalamide) fibers is dyed in less than 30 minutes.

12. The method of claim 8 wherein the amount of acetophenone carrier padded onto the surface of fibers is from about 1 to 2 wt. %, based on the weight of the fibers.

13. The method of claim 8 wherein the amount of the water-soluble cationic dye padded onto the surface of the fibers is from about 2 to 3 wt. %, based on the weight of the fibers.

14. A method of dyeing a tow of poly(m-phenylene isophthalamide) fibers, which tow has been dried, comprising the steps of padding onto the surface of the fibers of the tow an aqueous solution of from about 0.5 to 5 wt. % of a carrier, based on the weight of the fibers wherein said carrier is benzyl alcohol or a cyclic phosphorate ester, and from about 0.5 to 5 wt. % of a water-soluble cationic dye, based on the weight of the fibers, and thereafter heating the tow with steam at a temperature of about at least 120° C. for a time sufficient to dye the fibers on and closely adjacent the surface thereof.

15. The method of claim 14 wherein the carrier is benzyl alcohol.

16. The method of claim 14 wherein the carrier is a cyclic phosphonate ester.

17. The method of claim 14 wherein the tow is in the form of amorphous poly(m-phenylene isophthalamide) fibers.

18. The method of claim 14 wherein the tow is in the form of crystalline poly(m-phenylene isophthalamide) fibers.

19. The method of claim 14 wherein the tow of poly(m-phenylene isophthalamide) fibers is dyed in less than 30 minutes.

20. The method of claim 14 wherein the amount of carrier padded onto the surface of fibers is from about 1 to 2 wt. % based on the weight of the fibers.

21. The method of claim 14 wherein the amount of the cationic dye padded onto the surface of the fibers is from about 2 to 3 wt. % based on the weight of the fibers.

22. The method of claim 14 wherein the tow is heated with steam at a temperature of about 165° C. for a time sufficient to dye the fibers substantially to the center thereof.

* * * * *